US006412600B1

(12) United States Patent
Wolfman

(10) Patent No.: US 6,412,600 B1
(45) Date of Patent: Jul. 2, 2002

(54) NOTCH STABILIZED ROOF ACCESS LADDER

(76) Inventor: Henry Wolfman, 90 SW. 37th Ave., Ft. Lauderdale, FL (US) 33312

( * ) Notice: Subject to any disclaimer, the term of this patent is extended or adjusted under 35 U.S.C. 154(b) by 0 days.

(21) Appl. No.: 09/871,280

(22) Filed: May 31, 2001

(51) Int. Cl.[7] ..... E04G 5/02; E06C 1/36
(52) U.S. Cl. ..... 182/107; 182/206
(58) Field of Search ..... 182/107, 106, 182/108, 214, 129, 206; 248/210, 238

(56) References Cited

U.S. PATENT DOCUMENTS

| | | | | | |
|---|---|---|---|---|---|
| 466,816 | A | * | 1/1892 | Wilson | 182/108 |
| 1,035,770 | A | * | 8/1912 | Blair | 182/22 |
| 1,351,146 | A | * | 8/1920 | Zerlini | 182/22 |
| 2,963,104 | A | * | 12/1960 | Roth | 182/206 |
| 3,948,353 | A | * | 4/1976 | Lane | 182/206 |
| 4,179,011 | A | | 12/1979 | Morawski | 182/45 |
| 4,280,590 | A | | 7/1981 | Polizzi | 182/214 |
| 4,306,632 | A | | 12/1981 | Brown | 182/214 |
| 4,311,207 | A | | 1/1982 | Lurry | 182/206 |
| 4,458,783 | A | | 7/1984 | Stakes | 182/206 |
| 4,787,478 | A | | 11/1988 | Stakes | 182/206 |
| 4,836,331 | A | | 6/1989 | Foradori | 182/107 |
| 4,949,810 | A | | 8/1990 | Dwinnell | 182/214 |
| 5,121,813 | A | * | 6/1992 | Funston | 182/107 X |
| 5,180,032 | A | | 1/1993 | Hidalgo | 182/214 |
| 5,358,071 | A | | 10/1994 | Stennett | 182/214 |
| 5,664,643 | A | | 9/1997 | Taylor, Jr. | 182/214 |
| 5,775,465 | A | | 7/1998 | Vossler | 182/214 |
| 5,931,259 | A | | 8/1999 | Hoey | 182/107 |
| 6,019,191 | A | | 2/2000 | Flores | 182/107 |
| 6,082,689 | A | | 7/2000 | Bushway | 248/237 |

* cited by examiner

*Primary Examiner*—Daniel P. Stodola
*Assistant Examiner*—Hugh B. Thompson
(74) *Attorney, Agent, or Firm*—Frank L. Kubler

(57) ABSTRACT

A ladder for providing access to a building roof having a roof side edge includes first and second side rails which are substantially mutually parallel and laterally spaced apart from each other; and a longitudinal series of foot rungs extending perpendicularly between and interconnecting the first and second side rails; where the side rails have engaging notches directly opposite each other which are sized and shaped to receive and engaging a roof side edge to stabilize the ladder against pivoting and falling laterally.

7 Claims, 2 Drawing Sheets

NOTCH STABILIZED ROOF ACCESS LADDER

BACKGROUND OF THE INVENTION

1. Field of the Invention

The present invention relates generally to the field of ladders. More specifically the present invention relates to a ladder having side rails with engaging notches for receiving an edge of a roof as the ladder leans against the side of a building, thereby stabilizing the ladder against pivoting and falling laterally. The ladder has a ladder upper end and a ladder lower end and is formed of two substantially parallel side rails interconnected by a series of substantially perpendicular and spaced apart foot rungs, wherein the side rails have engaging notches directly opposite each other which are sized and shaped to receive an edge of a building roof.

The ladder is preferably an extension ladder, having a ladder lower segment and a ladder upper segment slidably mounted to the ladder lower segment, and the engaging notches are preferably provided in the ladder upper segment. It is preferred that a series of sets of mutually opposing engaging notches be provided in the side rails so that the most suitably located set of engaging notches can be selected for the particular height of the roof while the ladder leans against the building at an optimum stabilizing angle relative to the ground.

2. Description of the Prior Art

There have long been ladders, and particularly extension ladders, which have been leaned against the sides of buildings to permit the user to climb onto the roof. A problem with these ladders has been that the small amount of friction between the ladder side rails and the roof edge is often insufficient and to obstruct sideways sliding of the ladder upper end along the roof edge. As a result, these ladders sometimes pivot laterally from the ground and fall sideways as the user approaches the ladder upper end, so that the user is injured.

Various ladders and ladder bracing structures have been developed over the years. Problems with these structures have included complexity, high cost, bulkiness and ineffective stabilization while others have positioned the entire ladder on the roof so that ground access is not provided.

Morawski, U.S. Pat. No. 4,179,011, issued on Dec. 18, 1979, discloses a roofing ladder and ladder braces. A brace leg is pivotally suspended from the upper end of each ladder side rail and an abutment plate interconnects the brace legs. Bracing struts secure the brace legs at an outwardly pivoted, deployed position. The ladder side rails are placed against the roof surface one side of a peaked roof so that the brace legs extend over the peak and the abutment plate rests against the roof surface on the other side of the peak, securing the ladder against sliding off the roof. A generally similar roof peak engaging ladder attachment is taught in Lurry, U.S. Pat. No. 4,311,207, issued on Jan. 19, 1982.

Polizzi, U.S. Pat. No. 4,280,590, issued on Jul. 28, 1981, teaches a stabilizing attachment for ladders. Arms protrude perpendicularly from the ladder side rail upper ends for extending over the side edge of a peaked roof and abutting and gripping the roof surface, while the ladder lower end rests on the ground. Other ladder attachments including bracing arms which extend over and abut or grip the roof are those of Stakes, U.S. Pat. No. 4,458,783, issued on Jul. 10, 1984, for a triangular plate and cross-strut roof ladder attachment; Stakes, U.S. Pat. No. 4,787,478, issued on Nov. 29, 1988, for a converging linkage roof ladder attachment; Foradori, U.S. Pat. No. 4,836,331, issued on Jun. 6, 1989, for a ladder safety device-antislip, including rod arms which are slidably extendable from brackets at the ladder upper end; Flores, U.S. Pat. No. 6,019,191, issued on Feb. 1, 2000, for a ladder support system having two bracing arms which are pivotally attached to an axle bar secured across the ladder side rail upper ends to swing over and abut the roof top; Brown, U.S. Pat. No. 4,306,632, issued on Dec. 22, 1981, for a ladder support including a cluster of four bracing arm members diverging from the center of a cross-strut secured across the side rail upper ends; Dwinnell, U.S. Pat. No. 4,949,810, issued on Aug. 21, 1990, for an attachment to stabilize and expand the use of hollow rung ladders, having substantially triangular hoop members extending convergingly from corresponding side rail upper ends to function as bracing arms; Vossler, U.S. Pat. No. 5,775,465, issued on Jul. 7, 1998, for a ladder support including a square U-shaped brace defining a pair of outwardly extending bracing arms interconnected at their proximal ends by the base of the U-shape, the brace being pivotally secured with a pair of hinges to a square ladder encircling hoop releasibly fitting around the ladder upper end, the bracing arms each having a series of fastener holes for passing anchoring screws into the roof upper surface; Hildalgo, U.S. Pat. No. 5,180,032, issued on Jan. 19, 1993, for a ladder stabilizer apparatus usable on a extension ladder, the apparatus having two bracing legs with gripping blocks at their downwardly directed free ends which have resilient surfaces for engaging a roof upper surface; Stennett, U.S. Pat. No. 5,358,071, issued on Oct. 25, 1994, for a gutter protecting ladder attachment in which the bracing arms space the ladder upper end away from the roof edge a sufficient distance to protect the rain gutter; and Taylor, Jr., U.S. Pat. No. 5,664,643, issued on Sep. 9, 1997 for a multi-purpose ladder adapter with forwardly protruding composite bracing arms and clamp means for securing the apparatus around a ladder rung. Bushway, U.S. Pat. No. 6,082,689, issued on Jul. 4, 2000 for a roof staging bracket, does not appear to be directed to ladders specifically.

It is thus an object of the present invention to provide a roof access ladder which includes rail engaging notches for fitting around and over a side edge of a building roof to stabilize the ladder against pivoting and falling laterally.

It is another object of the present invention to provide such a ladder which has the same flat, narrow profile that an otherwise conventional ladder has for compact storage and transport.

It is still another object of the present invention to provide such a ladder having manufacturing costs which are virtually the same as those for a comparable, conventional ladder.

It is finally an object of the present invention to provide such a ladder which is sturdy and reliable.

SUMMARY OF THE INVENTION

The present invention accomplishes the above-stated objectives, as well as others, as may be determined by a fair reading and interpretation of the entire specification.

A ladder is provided for providing access to a building roof having a roof side edge including first and second side rails which are substantially mutually parallel and laterally spaced apart from each other; and a longitudinal series of foot rungs extending perpendicularly between and interconnecting the first and second side rails; where the side rails have engaging notches directly opposite each other which are sized and shaped to receive a roof side edge.

The engaging notches preferably each have substantially an inverted L-shape, defined by a notch horizontal segment and a notch vertical segment. The ladder preferably is an extension ladder including a ladder lower segment having two lower segment side rails and several lower segment foot rungs and a ladder upper segment having two upper segment side rails and several upper segment foot rungs, the ladder upper segment being slidably and telescopingly mounted to the ladder lower segment, and where the ladder upper segment includes the engaging notches. The side rails preferably include a series of sets of mutually opposing the engaging notches so that a suitably located the set may be selected for a particular roof height. The notch horizontal segments preferably each include a high friction substance for increasing the grip of the engaging notch on the roof side edge. The notch vertical segments also preferably each include a high friction substance for increasing the grip of the engaging notch on the roof side edge.

The ladder preferably additionally includes a pivot pin in each side rail; and a pivoting brace structure suspended from each pivot pin and having a pivoting brace structure downward surface extending across each engaging notch and defining the notch horizontal segment; where the pivoting brace structure pivots to continually orient itself with gravity so that the structure downward surface is continually oriented to be horizontal to rest flat against a top surface of a roof edge. Once again, the structure downward surface preferably includes a layer of high friction material.

BRIEF DESCRIPTION OF THE DRAWINGS

Various other objects, advantages, and features of the invention will become apparent to those skilled in the art from the following discussion taken in conjunction with the following drawings, in which.

Prior Art

DETAILED DESCRIPTION OF THE PREFERRED EMBODIMENTS

Figure 1:
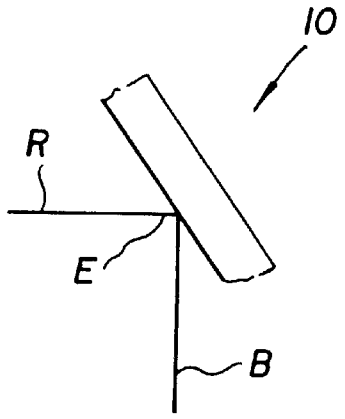
FIG. 1 PRIOR ART
FIG. 1 is a side view of a segment of a conventional ladder resting against the edge of a building roof, revealing the absence of any stabilizing means to prevent the ladder from sliding sideways.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 3:
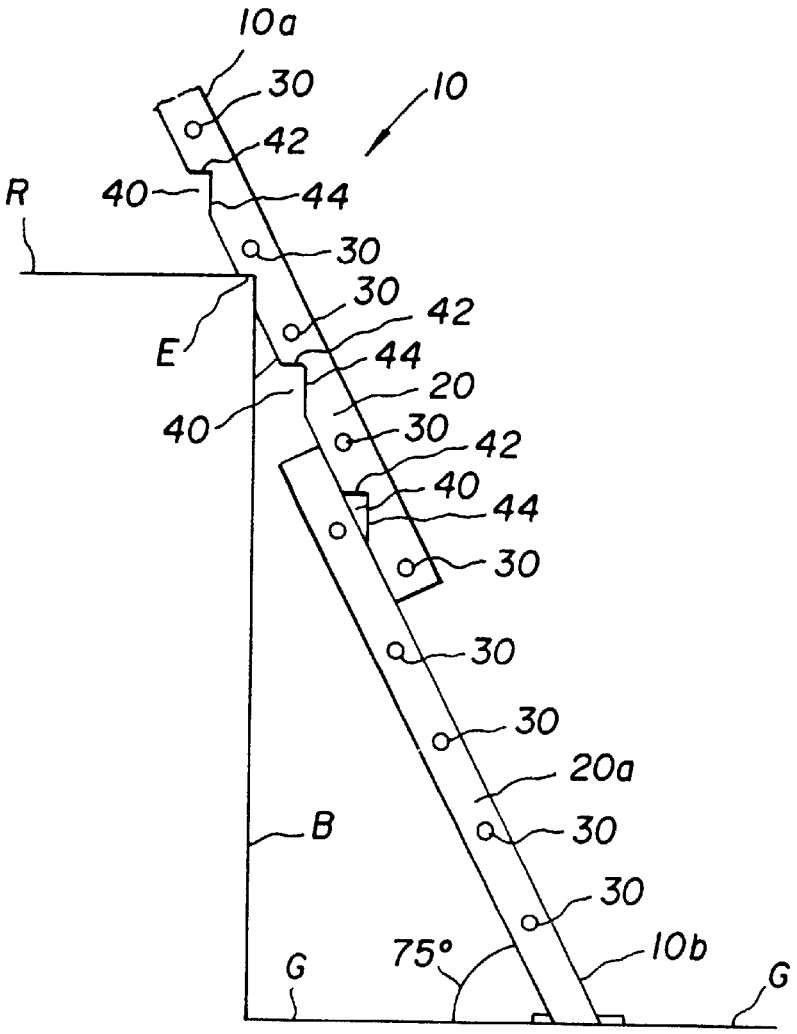
FIG. 3 is a side view of the ladder of FIG. 2, showing how the notches engage a roof edge.
Figure 2:
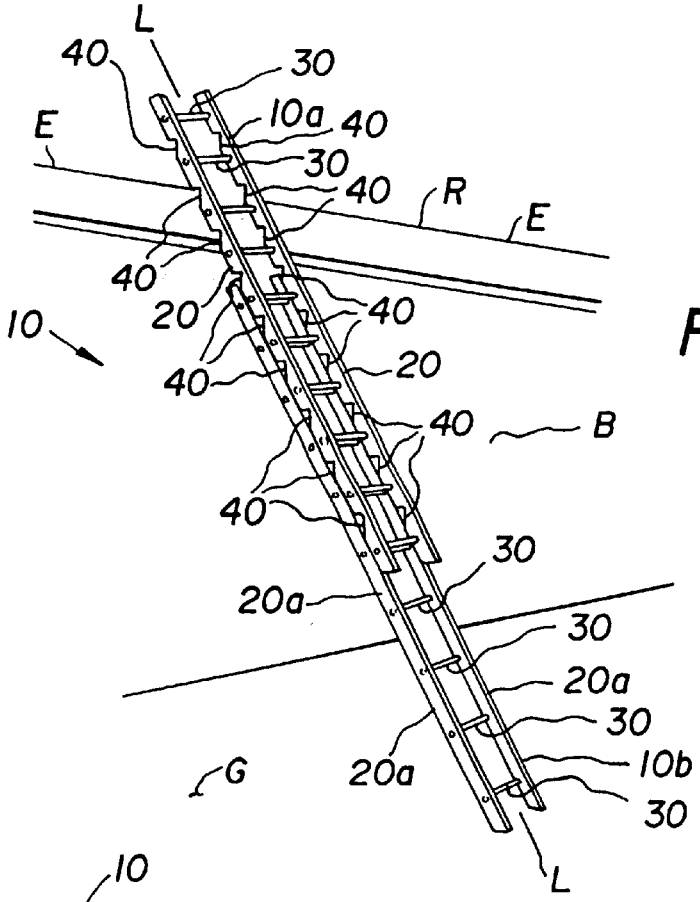
FIG. 2 is a full-length perspective view of an extension ladder of the first embodiment having the inventive stabilizing notches resting against a roof edge and braced by one of the several pairs of the notches.
Figure 4:
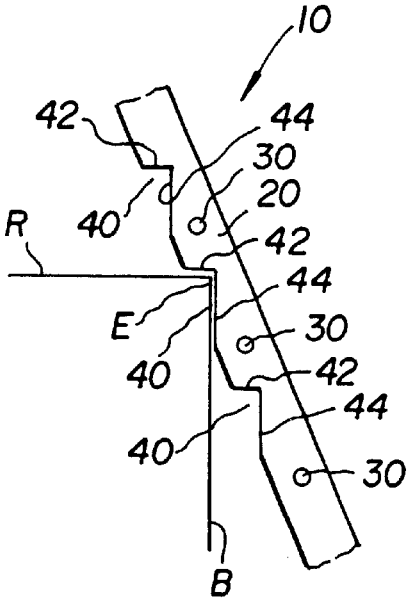
FIG. 4 is a partial side view of the first embodiment of the notched ladder as in FIG. 3.
Figure 5:
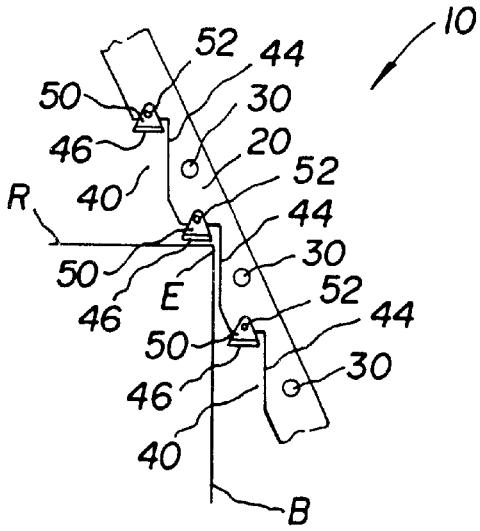
FIG. 5 is a partial side view of the second embodiment of the inventive notched ladder.

Referring to FIGS. 1–5, a roof access ladder 10 is disclosed having a ladder upper end 10*a* and a ladder lower end 10*b*, and which is formed of two substantially parallel side rails 20 interconnected by a series of spaced apart foot rungs 30 which are substantially perpendicular to the side rails 20, wherein the side rails 20 have engaging notches 40 directly opposite each other toward the ladder upper end 10*a* which are sized and shaped to receive an edge of a building roof R. As the ladder lower end 10*b* rests on the ground G and the ladder 10 leans against a building B so that side rails 20 rest against and extend above the edge E of the roof R, the engaging notches 40 fit around and over the roof edge E and abut the top surface of the roof R so that both side rails 20 are obstructed from moving downwardly and the ladder 10 therefore cannot tip over sideways. Engaging notches 40 preferably have an inverted L-shape, defined by a notch horizontal segment 42 and a notch vertical segment 44.

Ladder 10 is preferably an extension ladder, having a ladder lower segment 14 including two lower segment side rails 20*a* and several lower segment foot rungs 30*a* and a ladder upper segment 16 including two upper segment side rails 20 and several upper segment foot rungs 30 and slidably and telescopingly mounted to the ladder lower segment 14, the engaging notches 40 are preferably provided in the ladder upper segment 16.

It is preferred that a series of sets of mutually opposing engaging notches 40 be provided in side rails 20 so that the most suitably located set of engaging notches 40 can be selected for the particular height of the roof R while the ladder 10 leans against the building B at an optimum stabilizing angle relative to the ground G. For maximum stability and safety, the preferred angle of ladder 10 lean relative to the ground G is seventy-five degrees. The corresponding preferred angle of the notch horizontal segments 42 relative to the longitudinal axis L of the side rails 20 is also seventy-five degrees so that the horizontal segment 42 rests flat on top of a horizontal roof edge E while the ladder 10 leans against the building B at a seventy-five degree angle. The notch horizontal segment 42 is preferably coated with rubber or some other durable high friction substance 46 to increase the grip of the engaging notch 40 on the roof edge E. The notch vertical segment 44 is optionally coated with this substance as well.

A second embodiment of ladder 10 includes a pivoting brace structure 50 suspended from a pivot pin 52 in each side rail 20 and having a pivoting brace structure lower surface 54 extending across each engaging notch 40 to define the notch horizontal segment 42. See FIG. 5. The pivoting brace structure 50 pivots in a manner of a plumb bob to continually orient itself with gravity so that the structure lower surface 54 is continually horizontal and thus is always oriented to rest flat against the top surface of the roof edge E. Once again, the structure lower surface 54 is preferably covered with a layer of durable high friction material 46.

While the roof access ladder 10 is preferably used on buildings B with flat, horizontal roofs R, its use on angled and peaked roofs R is also contemplated. In these instances the forward corner of the engaging notch 40 may dig into and thereby grip the roof R, or the notch horizontal segment 42 may be formed at a non-horizontal angle corresponding to the roof R pitch.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A ladder for providing access to a building roof having a roof side edge and a roof upper surface, comprising:

first and second side rails which are substantially mutually parallel and laterally spaced apart from each other, said side rails each having a side rail longitudinal axis and having engaging notches directly opposite each other to receive a roof edge, each said engaging notch having a notch horizontal segment and a notch vertical segment which at least in part extends vertically, wherein said notch horizontal segment is oriented relative to its side rail longitudinal axis at an angle of substantially seventy five degrees from the side rail longitudinal axis, such that when said notch horizontal segment rests substantially flat on a roof upper surface, said ladder is oriented at a suitable angle for climbing;

and a longitudinal series of foot rungs extending perpendicularly between and interconnecting said first and second side rails.

2. The ladder of claim 1, wherein said ladder is an extension ladder comprising a ladder lower segment having two lower segment side rails and a plurality of lower segment foot rungs and a ladder upper segment having two upper segment side rails and a plurality of upper segment foot rungs, said ladder upper segment being slidably and telescopingly mounted to said ladder lower segment, and wherein said ladder upper segment comprises said engaging notches.

3. The ladder of claim 1, wherein said notch horizontal segments each comprise a high friction substance for increasing the grip of said engaging notch on the roof side edge.

4. The ladder of claim 1, wherein said notch vertical segments each comprise a high friction substance for increasing the grip of said engaging notch on the roof side edge.

5. A ladder for providing access to a building roof having a roof side edge, comprising:

first and second side rails which are substantially mutually parallel and laterally spaced apart from each other;

and a longitudinal series of foot rungs extending perpendicularly between and interconnecting said first and second side rails;

wherein said side rails have engaging notches directly opposite each other which are sized and shaped to receive a roof side edge;

a pivot pin in each said side rail;

and a pivoting brace structure suspended from each said pivot pin and having a pivoting brace structure downward surface extending across each said engaging notch and defining said notch horizontal segment;

wherein said pivoting brace structure pivots to continually orient itself with gravity such that said structure downward surface is continually oriented to be horizontal to rest flat against a top surface of a roof edge.

6. The ladder of claim 5, wherein said structure downward surface comprises a layer of high friction material.

7. A ladder for providing access to a building roof having a roof side edge and a roof upper surface, comprising:

first and second side rails which are substantially mutually parallel and laterally spaced apart from each other, said side rails each having a side rail longitudinal axis and having a series of sets of mutually opposing engaging notches to receive a roof edge, such that a suitably located said set may be selected for a particular roof height, each said engaging notch having a notch horizontal segment and a notch vertical segment which at least in part extends vertically, wherein said notch horizontal segment is oriented relative to its side rail longitudinal axis at an angle of substantially seventy five degrees from the side rail longitudinal axis such that when said notch horizontal segment rests substantially flat on a roof upper surface, said ladder is oriented at a suitable angle for climbing;

and a longitudinal series of foot rungs extending perpendicularly between and interconnecting said first and second side rails.

* * * * *